US010377028B2

(12) United States Patent
Grzybowski et al.

(10) Patent No.: US 10,377,028 B2
(45) Date of Patent: Aug. 13, 2019

(54) HAMMER PROTECTION SYSTEM AND METHOD

(71) Applicant: Caterpillar Inc., Peoria, IL (US)

(72) Inventors: Joshua Grzybowski, Waco, TX (US); Cody Moore, Waco, TX (US)

(73) Assignee: Caterpillar Inc., Deerfield, IL (US)

( * ) Notice: Subject to any disclaimer, the term of this patent is extended or adjusted under 35 U.S.C. 154(b) by 611 days.

(21) Appl. No.: 15/068,645

(22) Filed: Mar. 14, 2016

(65) Prior Publication Data

US 2017/0259421 A1 Sep. 14, 2017

(51) Int. Cl.

| | |
|---|---|
| ***B25D 9/16*** | (2006.01) |
| ***B25D 9/12*** | (2006.01) |
| ***B25D 9/18*** | (2006.01) |
| ***B25D 9/20*** | (2006.01) |
| ***B25D 9/26*** | (2006.01) |

(52) U.S. Cl.

CPC ..... *B25D 9/16* (2013.01); *B25D 9/12* (2013.01); *B25D 9/18* (2013.01); *B25D 9/20* (2013.01); *B25D 9/26* (2013.01)

(58) Field of Classification Search

CPC ... B25D 9/16; B25D 9/12; B25D 9/18; B25D 9/20; B25D 9/26; F16K 17/048

USPC ..... 173/1, 17, 177, 138, 207, 20, 206; 251/124

See application file for complete search history.

(56) References Cited

U.S. PATENT DOCUMENTS

| | | | | |
|---|---|---|---|---|
| 3,664,435 | A | 5/1972 | Klessig | |
| 4,281,587 | A * | 8/1981 | Garcia-Crespo | B25D 9/12 91/290 |
| 4,466,493 | A | 8/1984 | Wohlwend | |
| 4,474,248 | A * | 10/1984 | Musso | B25D 9/12 173/17 |
| 4,899,836 | A * | 2/1990 | Vernot | B25D 9/26 173/207 |
| 5,392,865 | A * | 2/1995 | Piras | B25D 9/145 173/137 |
| 5,479,996 | A | 1/1996 | Jönsson et al. | |
| 5,860,481 | A | 1/1999 | Prokop et al. | |
| 6,959,967 | B1 | 11/2005 | Prokop et al. | |
| 7,779,930 | B2 * | 8/2010 | Lohmann | B25D 9/265 173/115 |
| 8,167,055 | B2 * | 5/2012 | Piras | B25D 9/12 173/138 |

(Continued)

*Primary Examiner* — Andrew M Tecco
*Assistant Examiner* — Mary C Hibbert
(74) *Attorney, Agent, or Firm* — Oblon, McClelland, Maier & Neustadt

(57) ABSTRACT

A hydraulic hammer is provided. The hydraulic hammer includes a fluid inlet configured to receive a pressurized fluid for running the hydraulic hammer and a fluid outlet for discharging hydraulic fluid from the hydraulic hammer. A bypass passage fluidly connects the fluid inlet and the fluid outlet, the bypass passage has a bypass inlet fluidly connected to the fluid inlet and a bypass outlet fluidly connected to the fluid outlet. An automatic shut-off valve is disposed in the bypass passage between the bypass inlet and the bypass outlet and is configured to open or close the bypass passage. The automatic shut-off valve is configured to open the bypass passage under pressure of the pressurized fluid on continuous running of the hydraulic hammer for a set time to stop the hammer.

19 Claims, 4 Drawing Sheets

(56) References Cited

U.S. PATENT DOCUMENTS

| | | | | |
|---|---|---|---|---|
| 8,939,227 | B2 | 1/2015 | Theobalds | |
| 2012/0160528 | A1 * | 6/2012 | Theobalds | B25D 9/12 173/1 |

* cited by examiner

HAMMER PROTECTION SYSTEM AND METHOD

TECHNICAL FIELD

The present disclosure relates to the field of hydraulic hammer protection system and method. In particular, the present disclosure relates to an automatic shut-off valve assembly for hydraulic hammers.

BACKGROUND

Hydraulic hammers can be attached to various machines such as excavators, backhoes, tool carriers, or other like machines for the purpose of breaking stone, concrete and other construction materials. The hydraulic hammer is mounted to a boom of the machine and connected to a hydraulic system. High pressure fluid is then supplied to the hammer to drive a reciprocating piston and a work tool in contact with the piston.

Hydraulic hammers when operated tend to heat up due to inefficiencies in the system. An operator of the hydraulic hammer may not be able to track the time of continuous operation of the hammer and may run the hydraulic hammer for long durations. When a hydraulic hammer is operated continuously for long duration, the temperature of the components of the hydraulic hammer and the hydraulic fluid may exceed allowable limits and the excess heat built in the system may damage the components of the hydraulic hammer. The excess heat built up may also increase clearances in the hydraulic hammer which may negatively affect overall efficiency of the system. In certain situations, an uninterrupted continuous operation of the hammer may also result in failure of the hydraulic hammer or its components, for example bushings or seal members.

Therefore, it is desired to prevent the hydraulic hammers from prolonged continuous operation and protect the hammer from damage due to continuous operation for long hours. U.S. Pat. No. 3,664,435 provides a system for stopping the hammer when the load is removed from the hammer. The '435 patent describes discloses a bypass conduit within the hammer casing that fluidly connects the fluid inlet to the fluid outlet of the hammer, and a bypass valve that closes or opens the bypass conduit based on position of the tool in the hammer. However, such system does not protect the hammer from continuous running for long durations.

SUMMARY OF THE INVENTION

A hydraulic hammer is provided. The hydraulic hammer includes a fluid inlet configured to receive a pressurized fluid for running the hydraulic hammer and a fluid outlet for discharging hydraulic fluid from the hydraulic hammer. A bypass passage fluidly connects the fluid inlet and the fluid outlet, the bypass passage has a bypass inlet fluidly connected to the fluid inlet and a bypass outlet fluidly connected to the fluid outlet. An automatic shut-off valve is disposed in the bypass passage between the bypass inlet and the bypass outlet and is configured to open or close the bypass passage. The automatic shut-off valve is configured to open the bypass passage under pressure of the pressurized fluid on continuous running of the hydraulic hammer for a set time to stop the hammer.

A hydraulic hammer including a housing is provided. The hydraulic hammer has a piston arranged for reciprocating motion within the housing when the hydraulic hammer is run. The hydraulic hammer further includes a fluid inlet configured to receive pressurized fluid for running the hydraulic hammer and a fluid outlet for discharging hydraulic fluid from the hydraulic hammer. A bypass passage fluidly connects the fluid inlet and the fluid outlet. Further, the bypass passage has a bypass inlet fluidly connected to the fluid inlet and a bypass outlet fluidly connected to the fluid outlet. An automatic shut-off valve is disposed in the bypass passage between the bypass inlet and the bypass outlet and is configured to open or close the bypass passage. The automatic shut-off valve includes a first chamber fluidly connecting the bypass inlet to the bypass outlet, a spool configured to move within the first chamber between an open position to fluidly connect the bypass inlet to the bypass outlet and a closed position to fluidly disconnect the bypass inlet from the bypass outlet and a second chamber to hold a volume of fluid against the spool to restrict movement of spool from the closed position towards the open position based on flow of the volume of fluid from the second chamber. A first orifice is defined in the automatic shut-off valve. The first orifice is configured to allow flow of the volume fluid from the second chamber at a restricted rate to delay movement of the spool from closed position towards the open position by a set time.

A method of protecting a hydraulic hammer is provided. The hydraulic hammer has a fluid inlet for receiving pressurized hydraulic fluid for running the hammer and a fluid outlet to discharge fluid from the hydraulic hammer. A bypass passage fluidly connects the fluid inlet to the fluid outlet, and an automatic shut-off valve is positioned in the bypass passage and configured to open or close the bypass passage. The automatic shut-off valve includes a spool movable between a closed position to close the bypass passage and an open position to open the bypass passage. The automatic shut-off is valve biased towards the closed position. The method includes a step of operating the hammer by providing pressurized fluid through a passage connected to the fluid inlet and simultaneously moving the automatic shut-off valve from the closed position towards the open position under pressure of the pressurized fluid during a predetermined amount of continuous run time. The method further includes delaying movement of the automatic shut-off valve from the closed position to the open position for the predetermined amount of time by restricting movement of the spool by allowing fluid positioned between the spool and a check valve to pass through a first orifice defined in the spool at a restricted rate of flow and stopping the hydraulic hammer when the spool reaches the open position by opening the bypass passage.

DETAILED DESCRIPTION

Figure 1:
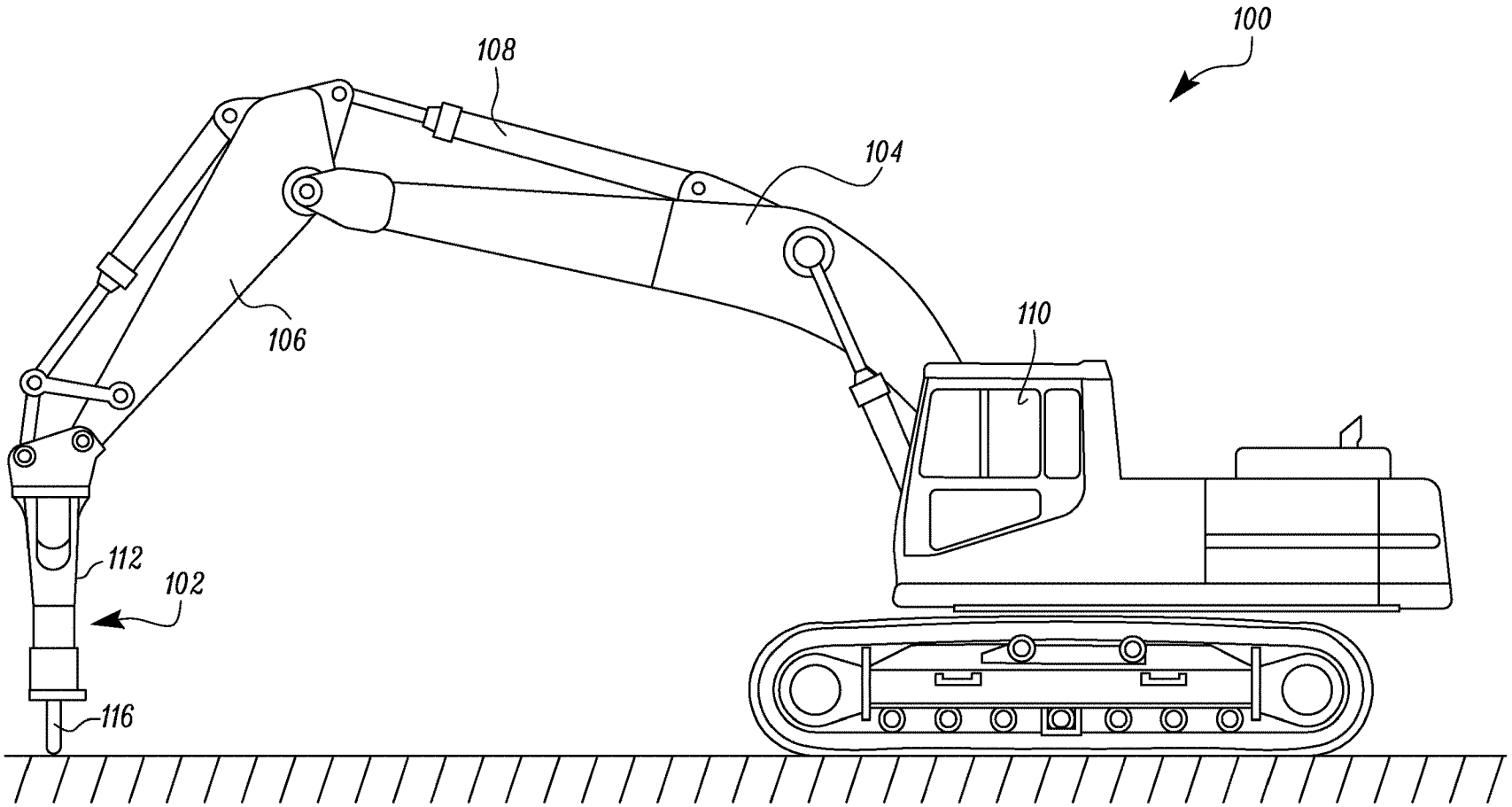
FIG. 1 illustrates schematic diagram of a work machine in accordance with an embodiment.

FIG. 1 illustrates an exemplary work machine 100 that may incorporate a hydraulic hammer, hereinafter referred to as a hammer 102. The work machine 100 may be configured to perform work associated with a particular industry such as, for example, mining or construction. For example, work machine 100 may be a backhoe loader, an excavator (shown in FIG. 1), a skid steer loader, or any other machine. The hammer 102 may be connected to the work machine 100 through a boom 104 and an arm 106. It is contemplated that other linkage arrangements known in the art to connect the hammer 102 to the work machine 100 may alternatively be utilized.

In the disclosed embodiment, one or more hydraulic cylinders 108 may raise, lower, and/or swing the boom 104 and the arm 106 to correspondingly raise, lower, and/or swing the hammer 102. The hydraulic cylinders 108 may be connected to a hydraulic supply system within the work machine 100. Specifically, the work machine 100 may include a hydraulic pump connected to the hydraulic cylinders 108 and to the hammer 102 through one or more hydraulic supply lines. The hydraulic supply system may introduce pressurized fluid, for example oil, from the pump and into the hydraulic cylinders 108. Operator controls for movement of the hydraulic cylinders 108 and/or the hammer 102 may be located within a cabin 110 of the work machine 100.

The hammer 102 may include an outer shell 112 and an actuator assembly 114 (shown in FIG. 2) located within the outer shell 112. A work tool 116 may be operatively connected to an end of the actuator assembly 114 opposite to the arm 106. It is understood that the work tool 116 may include any known tool capable of use with the hammer 102. In one embodiment, the work tool 116 includes a chisel bit.

Figure 2:
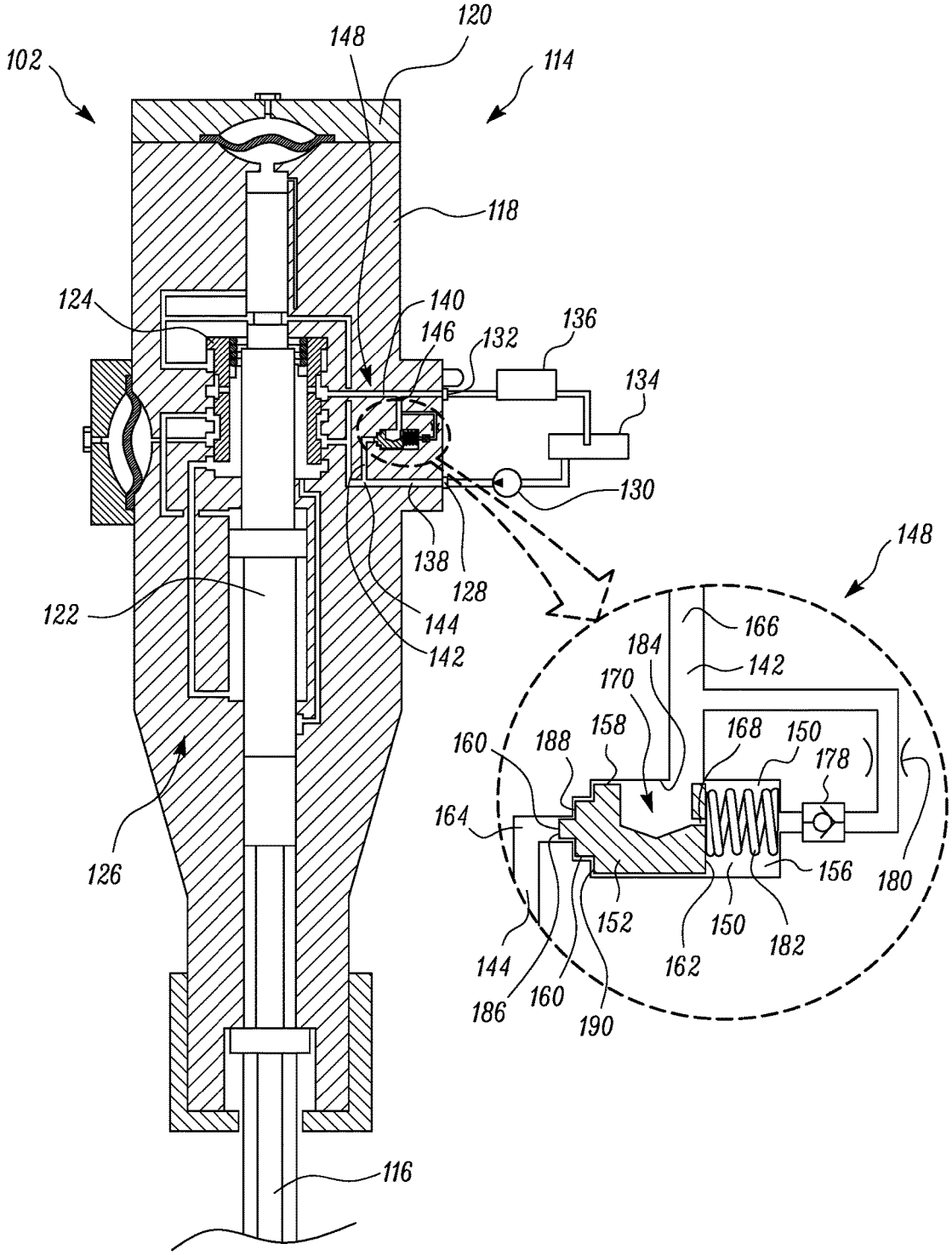
FIG. 2 illustrates a schematic cutaway view of a hammer and an enlarged view of a portion of the cutaway view in accordance with an embodiment.

As shown in FIG. 2, the actuator assembly 114 may include, among other things, a housing 118 and a head 120. The housing 118 may be a hollow cylindrical body and the head 120 may cap off one end of the housing 118. The actuator assembly 114 may further include, among other components, a piston 122, a distribution valve 124 and a hydraulic circuit 126 disposed in the housing 118 for actuating the piston 122 inside the housing 118. The piston 122 may be configured to reciprocate within both the housing 118 and the head 120 during operation of the hammer 102.

Referring to FIG. 2, the hammer 102 may include a fluid inlet 128 for receiving supply of pressurized fluid from a source of pressurized fluid 130, for example a hydraulic pump, and a fluid outlet 132 for returning fluid to the source of hydraulic fluid or a reservoir 134. The work machine 100 may include a cooling system 136 for cooling the hydraulic fluid. The cooling system 136 may be disposed between the fluid outlet 132 and the reservoir 134.

Further, the housing 118 may define an inlet passage 138 for receiving pressurized fluid from the fluid inlet 128 and supplying the fluid to the hydraulic circuit 126. An outlet passage 140 defined in the housing 118 may receive the fluid from the hydraulic circuit 126 and pass the fluid to the reservoir 134 via fluid outlet 132. The inlet passage 138 and the outlet passage 140 may be part of the hydraulic circuit 126.

Further, a bypass passage 142 may be defined in the housing 118. The bypass passage 142 fluidly connects the inlet passage 138 with the outlet passage 140. The bypass passage 142 may have a bypass inlet 144 and a bypass outlet 146. The bypass inlet 144 fluidly connects the bypass passage 142 to the fluid inlet 128 and the bypass outlet 146 fluidly connects the bypass passage 142 to the fluid outlet 132. An automatic shut-off valve, hereinafter referred to as a valve assembly 148, is disposed in the hydraulic circuit 126 to selectively open or close the bypass passage 142.

Figure 3:
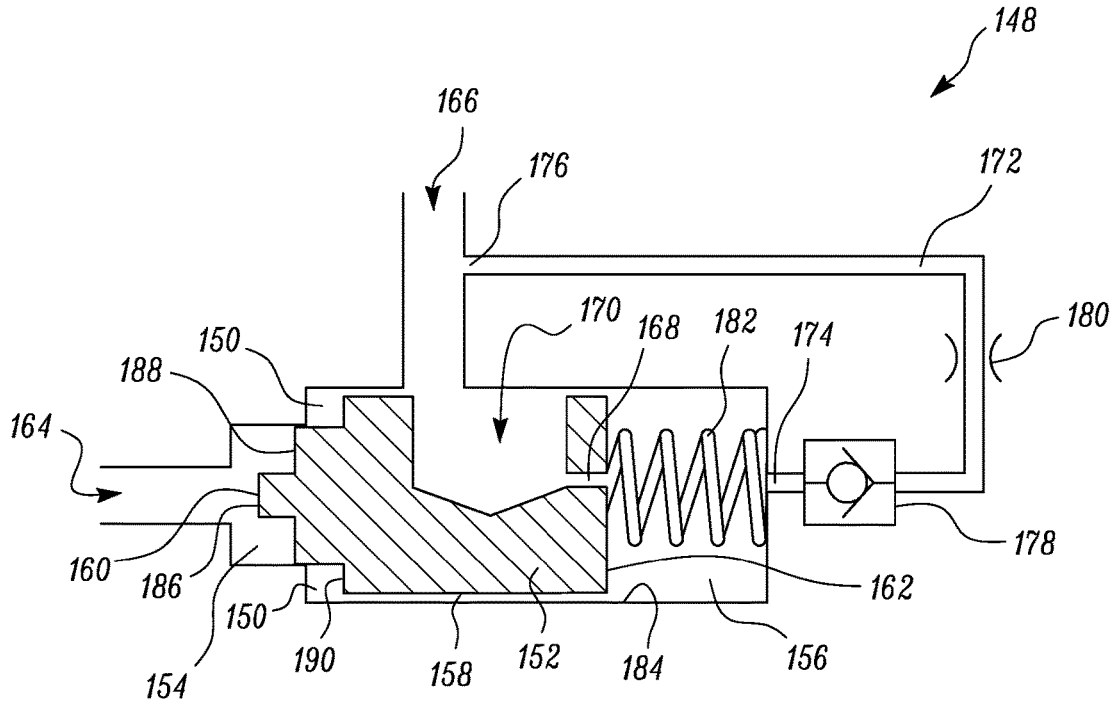
FIG. 3 illustrates a schematic arrangement of the automatic shut-off valve in accordance with an embodiment.
Figure 4:
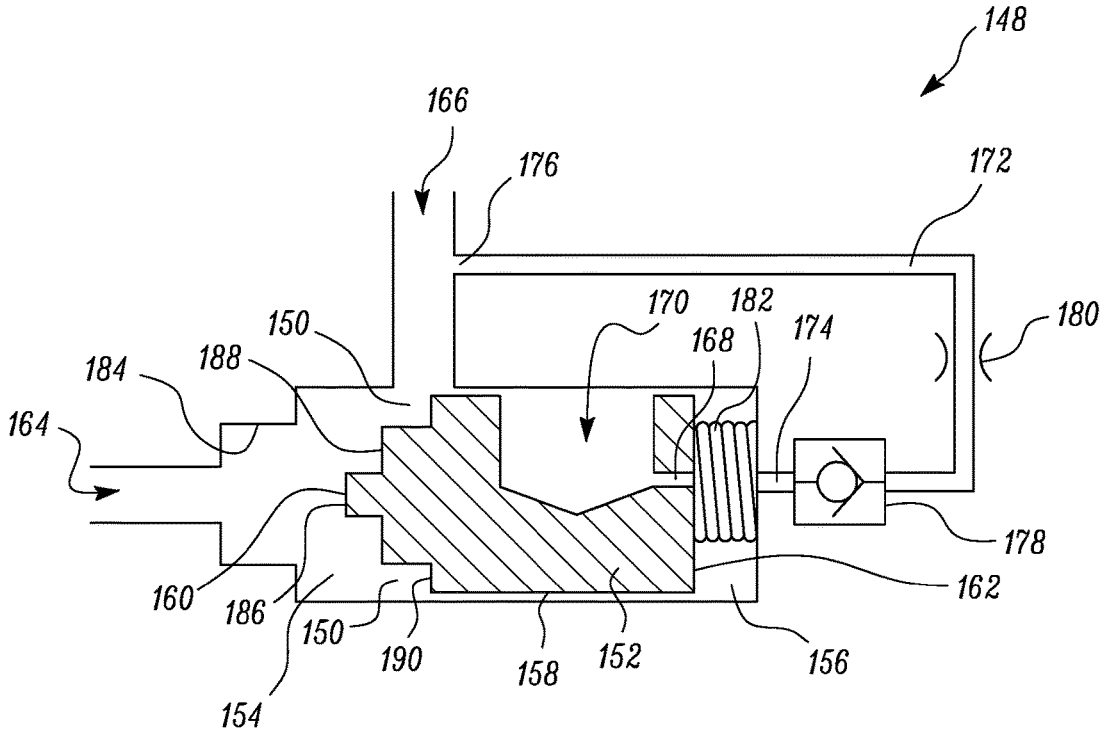
FIG. 4 illustrates a schematic arrangement of the automatic shut-off valve in accordance with an embodiment.
Figure 5:
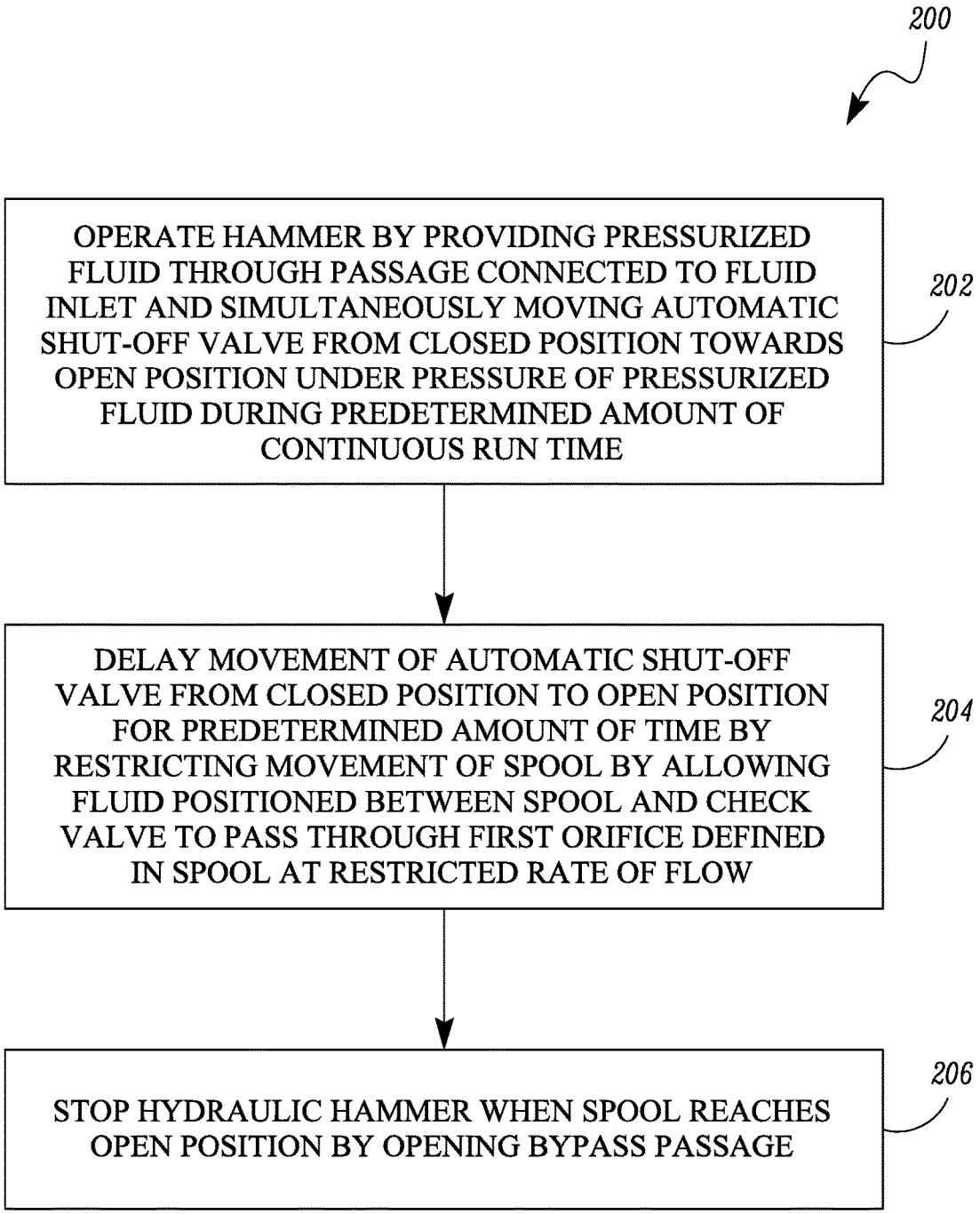
FIG. 5 illustrates a method of operation of a hydraulic hammer in accordance with the present disclosure.

Referring to FIGS. 2-4, the valve assembly 148 may be disposed in the bypass passage 142 between the bypass inlet 144 and the bypass outlet 146. In other embodiments, the valve assembly 148 may be disposed at an end of the bypass passage 142 interfacing with the inlet passage 138 or the outlet passage 140. The valve assembly 148 may selectively close or open the bypass passage 142. Opening of the bypass passage 142 may permit fluid in the inlet passage 138 to flow towards the outlet passage 140. When the bypass passage 142 is open, as the bypass passage 142 may provide for the least resistance path for the fluid in the inlet passage 138.

The valve assembly 148 may include a cavity 150 and a spool 152 disposed in the cavity 150. The cavity 150 and the spool 152 may define a first chamber 154 (shown in FIG. 4) and a second chamber 156 such that the spool 152 fluidly separates the first chamber 154 from the second chamber 156. The spool 152 may have an abutment surface 158 that abuts a wall 184 of the cavity 150 to fluidly separate the first chamber 154 from the second chamber 156. The abutment surface 158 may be configured to slide on the wall 184 of the cavity 150 to enable movement of the spool 152 inside the cavity 150. The spool 152 may be disposed movably in the cavity 150, such that movement of the spool 152 alters a volume defined in the second chamber 156. The spool 152 may further have a first surface 160 configured to face fluid in the first chamber 154 and a second surface 162 configured to face fluid in the second chamber 156.

Further, the valve assembly 148 may have a valve inlet 164 fluidly connecting the first chamber 154 to the bypass inlet 144 and a valve outlet 166 fluidly connecting the first chamber 154 to the bypass outlet 146. The bypass passage 142 may be opened by fluidly connecting the valve inlet 164 to the valve outlet 166. Similarly, the bypass passage 142 may be closed by fluidly disconnecting the valve inlet 164 from the valve outlet 166.

The spool 152 may be movable in the cavity 150 between an open position and a closed position. FIG. 2 illustrates the spool 152 in the closed position. As illustrated, in closed position, the first surface 160 of the spool 152 moves close to the valve inlet 164 such that the spool 152 fills the first chamber 154 and fluidly disconnects the valve outlet 166 from the valve inlet 164. FIG. 4 illustrates the spool 152 in the open position. As illustrated, the first surface 160 of the spool 152 moves away from the valve inlet 164 such that the spool 152 allows fluid connection of the valve outlet 166 and the valve inlet 164. Thus, the movement of the spool 152 between the closed position and the open position may close or open the automatic shut-off valve, respectively.

When the valve opens the bypass passage 142, the fluid entering from the fluid inlet 128 may be partially or completely returned to the reservoir 134 without doing any work in the hammer 102. On opening the bypass passage 142, the fluid entering the fluid inlet 128 may move from the inlet passage 138 to the outlet passage 140 through the bypass passage 142 and then out of the hammer 102 from the fluid outlet 132. When the bypass passage 142 is fully or partially open, the hammer 102 may be configured to stop operation or operate with reduced capacity. In the closed position, the valve assembly 148 may restrict any fluid flow in the bypass passage 142 and all the fluid received from the fluid inlet 128 may be directed for operation of the hammer 102 for reciprocating the piston 122 in the housing 118.

The second chamber 156 holds a volume of fluid against the second surface 162 of the spool 152. For moving the spool 152 from the closed position to the open position, the fluid in the second chamber 156 must escape to allow movement of the spool 152 towards the open position. The spool 152 may define a first orifice 168. The first orifice 168 may be positioned such that the first orifice 168 allows the fluid in the second chamber 156 to flow through the first orifice 168 towards the bypass outlet 146. As illustrated in FIGS. 2-4 the first orifice 168 may be defined on the second surface 162 of the spool 152 to allow fluid in the second chamber 156 to flow through the first orifice 168.

The spool 152 may further define an intermediate cavity 170 that provides for a passage for flow of fluid between the first orifice 168 and the bypass outlet 146 through the valve outlet 166. The dimensions of the first orifice 168 may be designed such that the first orifice 168 allows flow of fluid at a restricted rate or a slow rate.

The valve assembly 148 may further include a pressure equalization loop 172. The second chamber 156 may be fluidly connected to the bypass outlet 146 using the pressure equalization loop 172. The pressure equalization loop 172 may have a first end 174 fluidly connected to the second chamber 156 and a second end 176 fluidly connected to the bypass outlet 146. Further, a unidirectional check valve, hereinafter referred as check valve 178 may be disposed in the pressure equalization loop 172 to allow flow of fluid through the pressure equalization loop 172 from the second end 176 towards the first end 174. The check valve 178 ensure that any reverse flow, i.e. from the first end 174 towards the second end 176 is blocked. Thus, the check valve 178 ensure that pressure equalization loop 172 supplies fluid to the second chamber 156, whereas blocks any fluid from escaping the second chamber 156 through the pressure equalization loop 172. Therefore, fluid in the second chamber 156 can escape out only through the first orifice 168.

Further, the pressure equalization loop 172 may have a second orifice 180 for regulating rate of flow of fluid in the pressure equalization loop 172. The second orifice 180 may be designed to allow adequate flow of fluid from the second end 176 towards the first end 174 for supplying fluid to the second chamber 156. In an embodiment, the second orifice 180 may be configured to allow flow of fluid at a rate at least five times greater than the rate of flow of fluid allowed by the first orifice 168.

The spool 152 may be biased towards the closed position using a biasing member. The biasing member is designed such that the biasing member allows movement of the spool 152 towards the open position under pressure of the pressurized fluid when the hammer 102 is run. In the embodiment as illustrated, the biasing member is shown as a spring 182. It may be understood that any other known biasing mechanism may be used to bias the spool 152 towards the closed position. As illustrated, the spring 182 may be disposed in the second chamber 156 between the second surface 162 of the spool 152 and the wall 184 of the cavity 150.

The restricted flow through the first orifice 168 provides for delay in the movement of the spool 152 between the open position and the closed position. For moving the spool 152 from the closed position to the open position, the fluid in the volume of fluid in the second chamber 156 must escape to allow of movement of the spool 152 towards the open position.

Further, as illustrated in FIGS. 2-4, the first surface 160 of the spool 152 may be a stepped surface. As is known in the art, the force exerted by the spring 182 is proportional to the amount of compression or expansion of the spring 182. The stepped surface faces the pressurized fluid from the bypass outlet 146 for countering the biasing force exerted by the spring 182 on the second surface 162 of the spool 152 as the spool 152 compresses the spring 182 while moving from the closed position towards the open position. As illustrated, the wall 184 of the cavity 150 may define a corresponding surface to work with the first surface 160 with stepped construction. In stepped construction, the first surface 160 may have a first step surface 186, a second step surface 188 and a third step surface 190. The working of the stepped surface will be described later.

The operation of the hammer protection system will now be described. FIG. 2 illustrates the spool 152 of the valve assembly 148 in a closed position. In this state, the spring 182 pushes the spool 152 to the closed position and thus the bypass passage 142 is closed at this stage. For running the hammer 102, pressurized fluid is supplied through the fluid inlet 128. The pressurized fluid that is supplied through the fluid inlet 128 exerts pressure on the first surface 160 of the spool 152 as the fluid inlet 128 is fluidly connected to the valve inlet 164 through the bypass inlet 144. The pressure of the pressurized fluid starts moving the spool 152 from the closed position towards the open position.

Simultaneously, the volume of fluid from the second chamber 156 starts escaping through the first orifice 168. As the first orifice 168 allows flow of a fluid at a restricted rate, the volume of fluid escapes with a very slow rate of flow through the first orifice 168. Hence, the rate of movement of the spool 152 towards the open position depends on the rate of flow of the volume of fluid through the first orifice 168. As the volume of fluid gradually escapes, the spool 152 moves gradually towards the open position.

Further, as the spool 152 moves towards the open position under pressure of the pressurized fluid from the fluid inlet 128, the spool 152 compresses the spring 182. To counter the increase in biasing force of the spring 182, the first surface 160 has a stepped construction. Initially, the pressurized fluid exerts force on the first step surface 186. As the spool 152 moves towards the open position, as illustrated in FIG. 3, the spool 152 allows the pressurized fluid towards the second step surface 188 to the pressurized fluid. At this stage the pressurized fluid works now on the second step surface 188 in addition to the first surface 160. As known in the art, the force applied due to pressure is proportional to the amount surface area on which the pressure is applied. Thus, as the pressurized fluid reaches the second step surface 188, the net force that is applied on the first surface 160 is increased to counter the increase in biasing force of the spring 182. Similarly, as the spool 152 moves further towards the open position under pressure of the pressurized fluid the third step surface 190 is exposed to the pressurized fluid to further increase the net force due to pressure on the first surface 160 in order to counter further increase in biasing force created by the spring 182. It may be understood that the number of step surfaces and corresponding surface of the wall 184 of the cavity 150 may be designed based on different requirements.

As the spool 152 starts moving towards the open position, the spool 152 increases the pressure in the second chamber 156 and the volume of fluid in the second chamber 156 gradually escapes the second chamber 156 and flows out through the valve outlet 166 towards a low pressure area via intermediate cavity 170 in the spool 152. When the spool 152 reaches the open position, the valve inlet 164 gets fluidly connected to the valve outlet 166 which results in opening of the bypass passage 142. Once the bypass passage 142 opens, the fluid received in the hammer 102 through the fluid inlet 128 will be bypassed through the bypass passage 142 and thus no fluid will be supplied to the hydraulic circuit 126 for running the hammer 102. Until the spool 152 reaches the open position the bypass passage 142 remains closed so that the hammer 102 can run during the movement of the spool 152 from the closed position to the open position.

As the movement of the spool 152 from the closed position towards the open position depends on the rate of flow of the volume of fluid through the first orifice 168, the movement of the spool 152 is delayed by a set time. The set time may vary based on the volume of fluid stored in the second chamber 156 in the closed position and the dimensions of the cavity 150, the spool 152 and the first orifice 168. The set time may also vary depending upon the pressure of the pressurized fluid supplied to the fluid inlet 128. The valve assembly 148 may be designed based on different requirements to achieve different set times for the valve assembly 148.

Further, as the hammer 102 is stopped by opening the bypass passage 142, an operator may realize that the hammer 102 has stopped working and the supply of pressurized fluid to the hammer 102 can be stopped. As soon as the supply of pressurized fluid is stopped the spool 152 will move back towards the closed position under bias of the spring 182. Simultaneously, the second chamber 156 may be filled with fluid through the pressure equalization loop 172 due to low pressure created in the second chamber 156 by the movement of the spool 152 towards the closed position. The check valve 178 may allow fluid to flow into the second chamber 156 from the second end 176 of the pressure equalization loop 172. Once the spool 152 reaches back to the closed position, the bypass passage 142 is again closed and the hammer 102 can be run again.

In an embodiment, after the bypass passage 142 is opened due to continuous running of the hammer, the spool 152 may be configured to return to the closed position after a set delay. For example, the supply of fluid to the second chamber 156 for restoring the spool 152 in the closed position may be regulated at a restricted rate of flow to delay the return of the spool 152 to the closed position. The delay in returning of the spool 152 to closed position may provide for time for cooling off the hammer 102 before the hammer 102 is run again. This will prevent the hammer 102 from being run with excess heat buildup due to continuous operation of the hammer 102 for the set time.

INDUSTRIAL APPLICABILITY

The present disclosure provides for a hammer protection system for protecting a hammer 102 from damage caused by prolonged running of the hammer 102. The hammer protection system may stop the hammer 102 after continuous running of the hammer 102 for a set time. The hammer protection system in accordance with the present disclosure may prevent damage to the components of the hammer 102 or failure of the hammer 102 resulting due to excess heat buildup in the hammer 102 due to prolonged continuous operation. The hammer protection in accordance with the present disclosure may automatically stop the hammer 102 after continuous running for set time and thus alter an operator to take a preventive action.

Further, the present disclosure provides for a method 200 of protection of a hammer 102. The method 200 may include a step 202 of operating the hammer 102 by providing pressurized fluid through a passage connected to the fluid inlet 128 and simultaneously moving the automatic shut-off valve from the closed position towards the open position under pressure of the pressurized fluid during a predetermined amount of continuous run time. When the hammer 102 is run, the pressure of the pressurized fluid may initiate movement of the spool 152 from the closed position towards the open position.

The method 200 may further include a step 204 of delaying movement of the automatic shut-off valve from the closed position to the open position for the predetermined amount of time by restricting movement of the spool 152 by allowing fluid positioned between the spool 152 and a check valve 178 to pass through a first orifice 168 defined in the spool 152 at a restricted rate of flow. The second chamber 156 holds a volume of fluid against the second surface 162 of the spool 152. The check valve 178 may prevent the volume of fluid to escape through the pressure equalization loop 172 and the first orifice 168 positioned on the second surface 162 may have dimensions such as to allow flow of the volume of fluid in the second chamber 156 towards the valve outlet 166 at a very slow rate of flow and thereby delay movement of the spool 152 from the closed position towards the open position.

The method 200 may further include a step 206 of stopping the hammer 102 when the spool 152 reaches the open position by opening the bypass passage 142. The spool 152 upon reaching the open position fluidly connects the valve outlet 166 to the valve inlet 164 and bypasses the pressurized fluid from the fluid inlet 128 directly towards the fluid outlet 132. Hence, the hammer 102 ceases working in absence of supply of the pressurized fluid for driving the piston 122. This way the hammer 102 can be protected from damages that may result from continuous running of the hammer 102 beyond a set time.

The hammer protection system and method 200 in accordance with present disclosure may provide for a simplified system to prevent the hammer 102 from continuously running for more than the set time. The hammer protection system may be designed in accordance with set time requirements for different hammers.

The protection system on the work machine 100 may not be adequate for protection of the components of the hammer 102. The hammer protection system in accordance with the present disclosure may be positioned within the hammer 102. Thus, present disclosure provides for an inbuilt hammer protection system for the hammer 102. Accordingly, the hammer protection system in accordance with the present disclosure protects the hammer 102 from continuous running for long durations irrespective of whether the work machine 100 has a hammer protection system in place. Therefore, the hammer 102 incorporated with the hammer protection system in accordance with the present disclosure may be used with different work machines.

Further, the hammer protection system in accordance with the present disclosure provides for a simple and cost effective solution for protection of hammer 102 from prolonged continuous running. The hammer protection system in accordance with the present disclosure may reduce downtime and cost of service or maintenance by protecting the hammer 102 from damages occurring due to running the hammer 102 continuously for long durations.

What is claimed is:

1. A hydraulic hammer comprising:

a fluid inlet configured to receive a pressurized fluid for running the hydraulic hammer;

a fluid outlet for discharging hydraulic fluid from the hydraulic hammer;

a bypass passage fluidly connecting the fluid inlet and the fluid outlet, the bypass passage having a bypass inlet fluidly connected to the fluid inlet and a bypass outlet fluidly connected to the fluid outlet; and an automatic shut-off valve disposed in the bypass passage between the bypass inlet and the bypass outlet and configured to open or close the bypass passage, wherein the automatic shut-off valve is configured to open the bypass passage under pressure of the pressurized fluid on continuous running of the hydraulic hammer for a set time thereby stopping the hammer, wherein the automatic shut-off valve includes:

a cavity, and a spool provided in the cavity, the spool being movable within the cavity between an open position to fluidly connect the bypass inlet to the bypass outlet and a closed position to fluidly disconnect the bypass inlet from the bypass outlet, wherein an intermediate cavity and a first orifice are defined in the spool, the first orifice extending from the intermediate cavity to a second chamber, and wherein the first orifice is configured to allow flow of the volume of fluid through the first orifice from the second chamber at a restricted rate and thereby delay movement of the spool from the closed position to the open position under pressure of the pressurized fluid by the set time.

2. The hydraulic hammer of claim 1, wherein the automatic shut-off valve further includes:

a first chamber fluidly connecting the bypass inlet to the bypass outlet, the second chamber, which is configured to hold a volume of fluid against the spool to restrict the movement of the spool from the closed position to the open position, and a biasing member configured to bias the spool towards the closed position.

3. The hydraulic hammer of claim 2, further comprising:

a pressure equalization loop fluidly connecting the second chamber to the bypass outlet.

4. The hydraulic hammer of claim 3, wherein the pressure equalization loop has a unidirectional check valve configured to block a flow of the hydraulic fluid from a first end towards the bypass outlet.

5. The hydraulic hammer of claim 3, wherein the pressure equalization loop has a second orifice to restrict the flow of fluid in the pressure equalization loop, the second orifice is configured to allow the flow of fluid at a rate of at least five times greater than the rate of flow allowed by the first orifice.

6. The hydraulic hammer of claim 2, wherein the biasing member is a spring.

7. They hydraulic hammer of claim 6, wherein the spool pushes the spring while moving from the closed position to the open position, the spool having a stepped surface facing fluid from the bypass inlet to counter biasing force of the spring as the spool moves from the closed position to the open position.

8. The hydraulic hammer of claim 2, wherein the first orifice fluidly connects the second chamber to the bypass outlet.

9. A hydraulic hammer comprising:

a housing;

a piston arranged for reciprocating motion within the housing when the hydraulic hammer is run;

a fluid inlet configured to receive pressurized fluid for running the hydraulic hammer;

a fluid outlet for discharging hydraulic fluid from the hydraulic hammer;

a bypass passage fluidly connecting the fluid inlet and the fluid outlet, the bypass passage having a bypass inlet fluidly connected to the fluid inlet and a bypass outlet fluidly connected to the fluid outlet; and an automatic shut-off valve disposed in the bypass passage between the bypass inlet and the bypass outlet and configured to open or close the bypass passage, the automatic shut-off valve including:

a cavity, a first chamber fluidly connecting the bypass inlet to the bypass outlet, a spool provided in the cavity, the spool being movable within the cavity between an open position to fluidly connect the bypass inlet to the bypass outlet and a closed position to fluidly disconnect the bypass inlet from the bypass outlet, an intermediate cavity and a first orifice being defined in the spool, the first orifice extending from the intermediate cavity to a second chamber, and a second chamber to hold a volume of fluid against the spool to restrict movement of the spool from the closed position towards the open position based on a flow of the volume of fluid from the second chamber, wherein the first orifice is configured to allow the flow of the volume fluid from the second chamber at a restricted rate to delay movement of the spool from the closed position towards the open position by a set time.

10. The hydraulic hammer of claim 9, wherein the automatic shut-off valve further comprises a biasing member configured to bias the spool towards the closed position.

11. The hydraulic hammer of claim 10, wherein the biasing member is a spring, the spool configured to push the spring while moving from the closed position to the open position, the spool having a stepped surface facing fluid from the bypass inlet to counter increase in biasing force of the spring as the spool moves from the closed position towards the open position.

12. The hydraulic hammer of claim 9, further comprising:

a pressure equalization loop fluidly connecting the second chamber to the bypass outlet.

13. The hydraulic hammer of claim 12, wherein the pressure equalization loop has a unidirectional check valve to allow the flow of fluid from the bypass outlet towards the second chamber and block flow of fluid from the second chamber towards the bypass outlet.

14. The hydraulic hammer of claim 12, wherein the pressure equalization loop has a second orifice to restrict the flow of fluid in the pressure equalization loop, the second orifice is configured to allow the flow of fluid at a rate of at least five times greater than the rate of flow allowed by the first orifice.

15. The hydraulic hammer of claim 9, wherein the bypass passage and the automatic shut-off valve are positioned in the housing.

16. The hydraulic hammer of claim 9, wherein the first orifice fluidly connects the second chamber to the bypass outlet.

17. A method of protecting a hydraulic hammer, the hydraulic hammer having a fluid inlet for receiving a pressurized fluid for running the hammer and a fluid outlet to discharge fluid from the hydraulic hammer, a bypass passage fluidly connecting the fluid inlet to the fluid outlet, and an automatic shut-off valve positioned in the bypass passage and configured to open or close the bypass passage, the automatic shut-off valve comprising a spool provided in a cavity and movable in the cavity between a closed position to close the bypass passage and an open position to open the bypass passage, the automatic shut-off valve being biased towards the closed position, an intermediate cavity and a first orifice being defined in the spool, the first orifice extending from the intermediate cavity to a second chamber, and the first orifice being configured to allow flow of the volume of fluid through the first orifice from the second chamber at a restricted rate and thereby delay movement of the spool from the closed position to the open position under pressure of the pressurized fluid by the set time, the method comprising:

operating the hammer by providing the pressurized fluid through a passage connected to the fluid inlet and simultaneously moving the automatic shut-off valve from the closed position towards the open position under pressure of the pressurized fluid during a predetermined amount of continuous run time;

delaying movement of the automatic shut-off valve from the closed position to the open position for the predetermined amount of time by restricting movement of the spool by allowing fluid positioned between the spool and a check valve to pass through the first orifice defined in the spool at a restricted rate of flow; and stopping the hydraulic hammer when the spool reaches the open position by opening the bypass passage.

18. The method of claim 17, further comprising:

restoring the spool in the closed position after stopping the hydraulic hammer by allow fluid to fill in the second chamber.

19. The method of claim 18, wherein the second chamber is filled by fluid received from a pressure equalization loop, the pressure equalization loop configured to selectively fluidly connect the second chamber to a bypass outlet.

* * * * *